United States Patent [19]

Beaston

[11] 3,953,958

[45] May 4, 1976

[54] SPUR

[76] Inventor: Bud A. Beaston, Rte. 1, Box 13, Sperry, Okla. 74073

[22] Filed: Mar. 31, 1975

[21] Appl. No.: 563,313

[52] U.S. Cl. ..... 54/83 A
[51] Int. Cl.[2] ..... A43C 17/00
[58] Field of Search ..... 54/83 R, 83 A

[56] References Cited

UNITED STATES PATENTS

| | | | |
|---|---|---|---|
| 769,743 | 9/1904 | Hanaway | 54/83 A |
| 987,905 | 3/1911 | Monier | 54/83 A |
| 2,454,228 | 11/1948 | Smith | 54/83 A |

*Primary Examiner*—Louis G. Mancene
*Assistant Examiner*—Jack Q. Lever
*Attorney, Agent, or Firm*—William S. Dorman

[57] ABSTRACT

A spur for engagement with a boot of the type having an upper foot-engaging portion, an outer sole attached to the bottom of said upper portion and a heel attached to said boot at the rear of said outer sole, and wherein a groove is formed in the boot around the lower periphery of the upper portion by the inturned lower edge of the upper portion against the outer sole; the spur comprises a pair of forwardly directed arms which are connected at their rear ends in a curved portion to form a bell-shaped yoke; the yoke, in cross-section, has an upwardly and inwardly inclined profile which is tapered convergently upwardly; the yoke is also provided with a rounded lower edge from which a narrow rim projects inwardly and which is adapted to be received in the groove of the boot above and surrounding the heel; the spur is also provided with a pair of forwardly and upwardly directed ears which are pivotally attached to the forward ends of the arms along forwardly and downwardly directed hinge axes, respectively; each ear is provided with an outwardly directed button adapted to engage a conventional strap portion such that the strap portions can be fastened together above and forward of the instep portion of the boot to retain the spur firmly on the boot. The rim of the spur, at the rear portion thereof, projects forwardly and inwardly merely to the extent of the depth of the groove on the boot; at the forward portions, the rim projects inwardly to a lesser extent than the depth of the groove; the inner edge at the rear portion of the rim gradually tapers into the inner edges of the rim at the forward portions thereof. The forward and upward angle of the ears with respect to the forward ends of the yoke is such that, when the strap portions are firmly engaged, a forward thrust against the spur causes the rear portion thereof to be pulled into the groove at the rear end of the boot; a forward and upward thrust at the forward ends of the arms assists in maintaining the spur firmly on the boot.

3 Claims, 5 Drawing Figures

SPUR

BACKGROUND OF THE INVENTION

1. Field of the Invention

The present invention relates to a spur and, more particularly, to a spur which can be firmly and readily secured to a boot.

2. The Prior Art

Many and different varieties of spurs have been known for years. A spur, such as disclosed in Smith U.S. Pat. No. 2,454,228 is deemed worthy of note as being pertinent to the present invention. The Smith patent discloses an inner rim, or inturned flange, which is adapted to be positioned in the groove which normally exists between the upper portion of the shoe and the outer sole due to the inturned lower edge construction of the shoe. However, the inturned flange or rim on the Smith spur is such as to extend inwardly beyond the normal depth of the groove; as such, the Smith spur would tend to loosen the connection between the upper portion of the shoe and the outer sole thereof thereby causing damage to the shoe; also, the loosening of this connection between the upper portion of the shoe and the outer sole in Smith would result in the spur falling off of the boot, since Smith provides no other connection between the spur and the boot.

SUMMARY OF THE INVENTION

The present invention relates to a spur for engagement with a boot of the type having an upper foot-engaging portion, an outer sole attached to the bottom of said upper portion and a heel attached to the boot at the rear end of the outer portion and wherein a groove is formed in the boot around the lower periphery of the upper portion by the inturned lower edge of the upper portion against the outer sole. The spur comprises a pair of forwardly directed arms connected at their rear ends in a curved portion to form a bell-shaped yoke; the yoke has an upwardly and inwardly inclined cross-section which is tapered convergently upwardly; the yoke is also provided with a rounded lower edge and a narrow rim projecting inwardly from the lower edge and adapted to be received in the groove of the boot above and surrounding the heel. The spur also includes a pair of forwardly and upwardly directed ears pivotally attached to the forward ends of the arms along forwardly and downwardly directed hinge axes, respectively; each ear is provided with an upwardly directed button adapted to engage a strap portion, whereby the strap portions can be fastened together above and forward of the instep portion of the boot to retain the spur thereon. As distinguished from the Smith patent, referred to above, the rim or inner flange, as it is referred to in Smith, projects forwardly and inwardly merely to the extent of the depth of the groove so that the rim on the spur of the present invention does not tend to separate the upper portion of the boot from the outer sole thereof. At the forward portions of the rim, the rim projects inwardly into the groove a lesser extent than the depth of the groove; the inner edge at the rear portion of the rim gradually tapers along both sides of the spur into the inner edges of the rim at the forward portions thereof. It should be further noted that the ears are connected to the arms of the spur at forward and upward angles such that, when the strap portions are firmly engaged, a forward thrust will urge the rear portion of the spur into the groove and a forward and upward thrust will be present at the forward ends of the arms so as to hold the spur firmly on the boot.

DESCRIPTION OF THE PREFERRED EMBODIMENT

Figure 1:
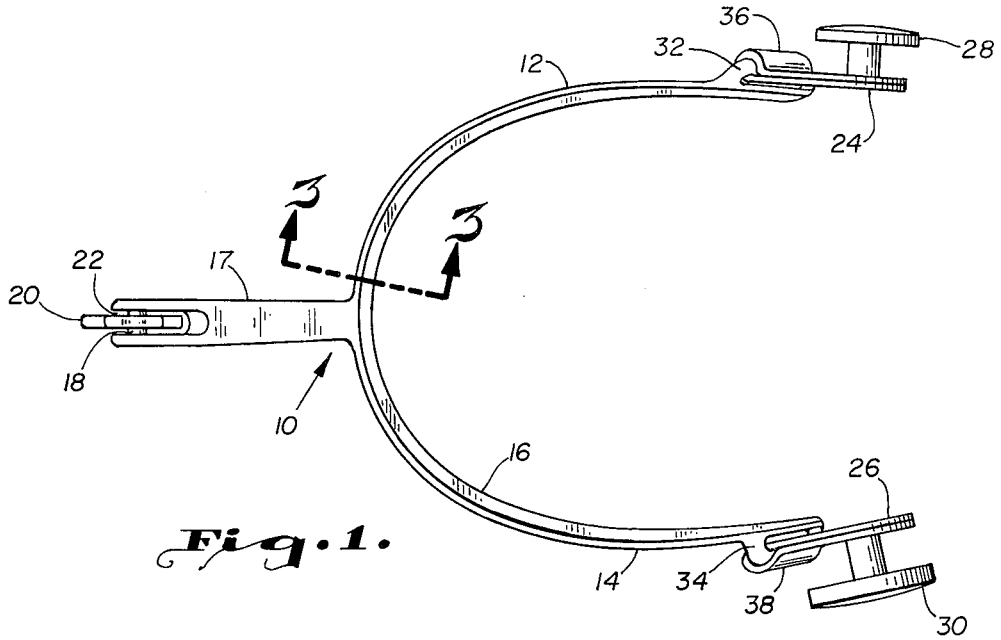
FIG. 1 is a plan view of the spur of the present invention.
Figure 3:
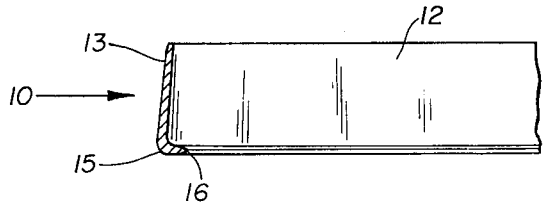
FIG. 3 is a fragmentary sectional view of the spur taken along section line 3—3 of FIG. 1.

Referring to the drawings in detail, FIG. 1 shows a spur, generally designated by the reference character 10, and having forwardly directed arms 12 and 14. These arms merge together at the rear in a curved portion to form a resulting bell-shaped yoke. As will appear from a consideration of FIG. 3, the yoke has an upwardly and inwardly inclined cross-section 13 which is tapered convergently upwardly and a rounded lower edge 15. A narrow rim 16 projects inwardly from the lower edge and, as best shown in FIG. 4, is adapted to be received in the groove 48 of the boot as will be described hereinafter.

Figure 2:
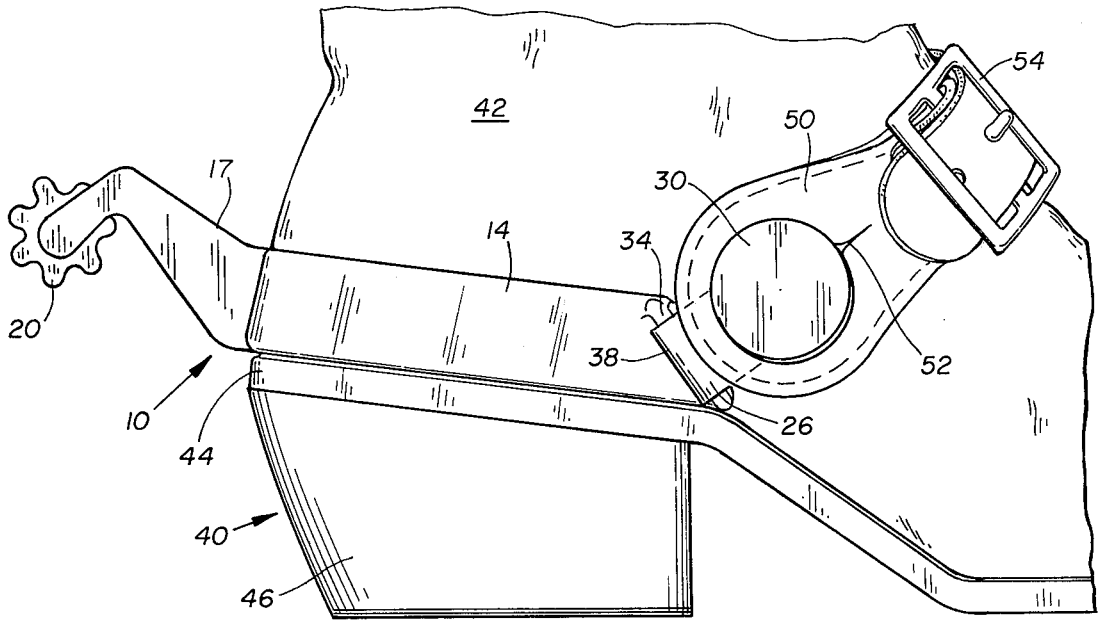
FIG. 2 is a side view of the spur shown in FIG. 1 and showing its attachment to a boot, only a portion of which is shown.
Figure 5:
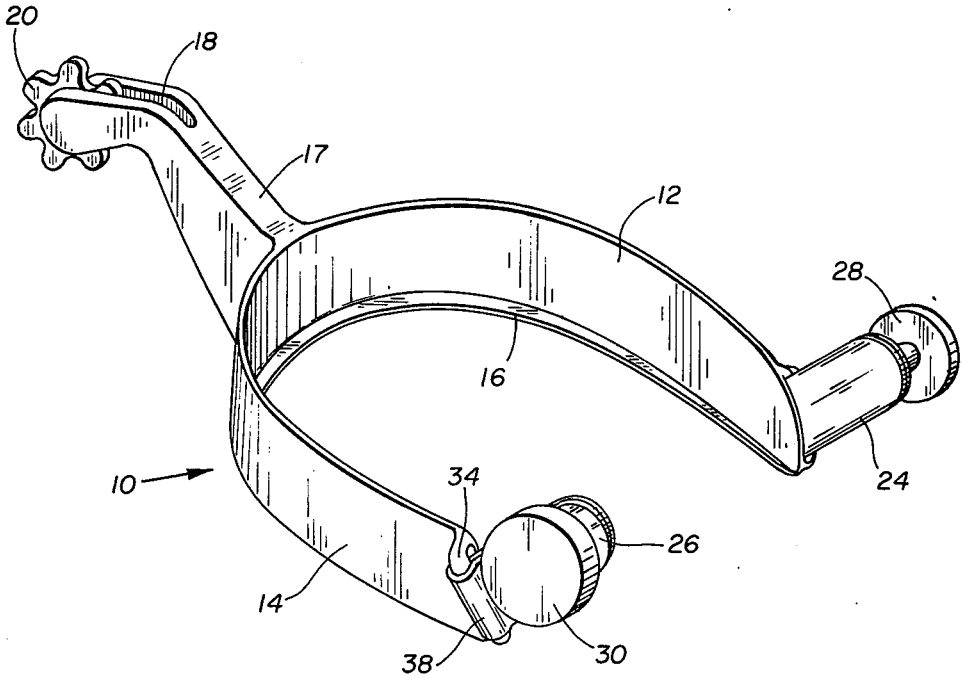
FIG. 5 is a perspective of the spur shown in FIG. 1.

As best shown in FIGS. 1, 2 and 5, the spur 10 is also provided with a rearwardly and upwardly directed shank 17 which has an aperture 18 therein. Within the aperture is mounted a rowel 20 which is pivotally supported on a pin 22. At the forward ends of the arms 12 and 14 are mounted a pair of forwardly and upwardly inclined ears 24 and 26, respectively. A pair of outwardly projecting buttons 28 and 30 are mounted on the ears 24 and 26 for a purpose which will hereinafter appear. The ears 24 and 26 are mounted on hinge axes which are downwardly and forwardly directed. These hinge axes are formed by hinge shafts 32 and 34 on the outer ends of the arms 12 and 14. These hinge shafts are forwardly and downwardly directed as shown. The arms 24 and 26 are formed of strips of metal which are bent around the hinge shafts 32 and 34 so as to provide the hinge loops 36 and 38 respectively.

As indicated heretofore, the spur of the present invention is designed for engagement with a boot or shoe, generally designated by the reference character 40. Although this item of footwear will be hereinafter referred to as a "boot", it should be understood that this designation also includes what might be normally referred to as a "shoe". At any event, the boot 40 is provided with a conventional upper portion 42, an outer sole 44 and a heel 46 which is secured to the rear portion of the shoe or outer sole 44 as shown.

Figure 4:
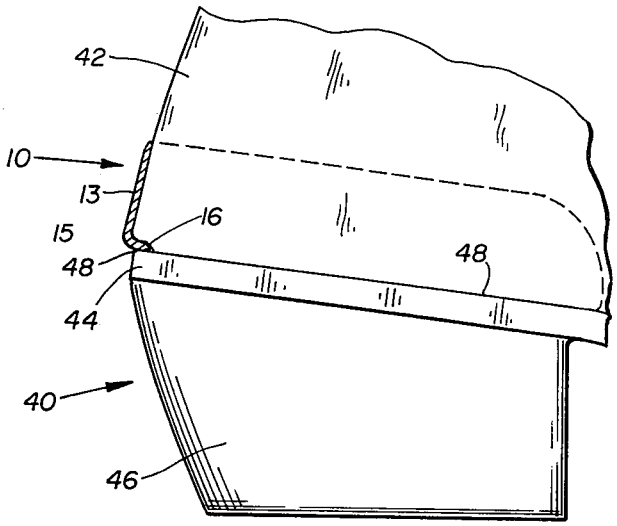
FIG. 4 is a view similar to FIG. 3 but showing the relationship between the spur and the boot and, more particularly, how the inner rim is received in the conventional groove in the boot.

As best shown in FIG. 4, the boot is provided with a normally existing groove 48 which is due to the inturned lower edge of the upper portion 42 against the outer sole 44.

The buttons 28 and 30 are each adapted to engage a strap portion 50 by virtue of a slit 52 provided in each strap portion. The strap portions are held together by a conventional buckle 54 which is adjustable to provide the desired tension on the strap portions 50.

Returning now to a consideration of FIG. 4, the rim 16, at the rear of the spur, is designed to project into the groove 48 a distance equal to the depth of the groove itself, thus avoiding any tendency to provide a separation of the upper portion 42 from the outer sole 44; at the same time, the inner forward edges of the rim 16, as best shown in FIGS. 1 and 5, extend inwardly to an extent less than the depth of the groove 48 to facilitate placement of the spur 10 on the boot 40.

It should be noted that the buttons 28 and 30, by virtue of their placement on the upwardly and forwardly directed ears 24 and 26, respectively, are above and forward of the yoke formed by the arms 12 and 14. The relationship thus shown in FIG. 2 results in a forward thrust being exerted against the rear of the spur 10 to cause firm engagement of the rear portion of the rim 16 with the groove 48; at the same time, the force on the forward end of the spur is forward and upward to hold the spur firmly engaged against the boot.

As best shown in FIGS. 2 and 5, the shank portion 17 is upwardly and rearwardly directed and has a rotatable rowel 20 mounted thereon. This is to be distinguished from the downwardly directed shank of the Smith patent, described above, and the more conventional horizontally directed shanks more commonly found in the prior art. As a result of the present arrangement, the rowel 20 is located above the yoke formed by the arms 12 and 14. Thus when the heels of the boot are inwardly directed towards the horse (which the spur wearer may be riding), the rowels 20 will readily engage the sides or belly of the horse, even where the horse is a smaller animal such as a quarter horse. It has been noted, for example, where the horizontally or downwardly positioned rowels are employed with smaller horses, these rowels may miss contact with the animal.

Whereas the present invention has been described in particular relation to the drawings attached hereto, it should be understood that other and further modifications, apart from those shown or suggested herein, may be made within the spirit and scope of this invention.

What is claimed is:

1. A spur for engagement with a boot of the type having an upper foot-engaging portion, an outer sole attached to the bottom of said upper portion and a heel attached to said boot at the rear of said outer sole, and wherein a groove is formed in said boot around the lower periphery of said upper portion by the inturned lower edge of said upper portion against said outer sole, comprising: a pair of forwardly directed arms connected at their rear ends in a curved portion to form a bell-shaped yoke; said yoke having an upwardly and inwardly inclined cross-section which is tapered convergently upwardly; said yoke having a rounded lower edge and a narrow rim projecting inwardly from said lower edge and adapted to be received in the groove of said boot above and surrounding said heel, said rim, at the rear portion thereof, projecting forwardly and inwardly merely to the extent of the depth of said groove and, at the forward portions thereof, projecting inwardly to a lesser extent than the depth of said groove, the inner edge at the rear portion of said rim gradually tapering into the inner edges of said rim at the forward portions thereof; a pair of forwardly and upwardly directed ears pivotally attached to the forward ends of said arms respectively along forwardly and downwardly directed hinge axes; each ear having an outwardly directed button adapted to engage a strap portion, whereby said strap portions can be fastened together above and forward of the instep portion of the boot to retain said spur thereon.

2. A spur as set forth in claim 1 wherein the forward and upward angle of said ears with respect to the forward ends of said arms is such, when said strap portions are firmly engaged, as to result in a forward thrust of said spur at the rear portion thereof into said grooves and a forward and upward thrust at the forward ends of said arms to hold said spur firmly on said boot.

3. A spur as set forth in claim 1 wherein an upwardly and rearwardly directed shank is connected to the rear of said yoke, said shank having a vertical aperture therein and a rowel rotatably received within the aperture of said shank portion.

* * * * *